United States Patent [19]

Ruprecht et al.

[11] 4,166,364

[45] Sep. 4, 1979

[54] CARBON DIOXIDE SNOW HOOD

[75] Inventors: David R. Ruprecht, Laurys Station; Norris G. Lovette, Breinigsville, both of Pa.

[73] Assignee: Air Products and Chemicals, Inc., Allentown, Pa.

[21] Appl. No.: 905,913

[22] Filed: May 15, 1978

[51] Int. Cl.[2] ..... F25D 3/12

[52] U.S. Cl. ..... 62/384; 62/35

[58] Field of Search ..... 62/10, 12, 35, 76, 384, 62/347

[56] References Cited

U.S. PATENT DOCUMENTS

| | | | |
|---|---|---|---|
| 3,757,367 | 9/1973 | Campbell | 62/10 |
| 3,807,187 | 4/1974 | Vorel | 62/76 |

*Primary Examiner*—Ronald C. Capossela

*Attorney, Agent, or Firm*—Ronald B. Sherer; E. Eugene Innis; Barry Moyerman

[57] ABSTRACT

A carbon dioxide snow hood is disclosed for separating gaseous and solid carbon dioxide particles and depositing a uniform blanket of the carbon dioxide particles in the form of snow on articles to be cooled.

5 Claims, 4 Drawing Figures

CARBON DIOXIDE SNOW HOOD

BACKGROUND OF THE INVENTION

In many processing applications it is desired to contact various products with solid carbon dioxide in the form of particles or flakes, hereinafter referred to as snow, rather than in the form of pellets or chips of so-called dry ice. For example, it may be desired to deposit a blanket of carbon dioxide snow over a food product in a container, or to mix carbon dioxide snow in a meat mixer such as a sausage mixing machine, or to cool heat sensitive materials such as polymeric powders during processing.

One commercially used method and apparatus for producing and depositing carbon dioxide snow is that performed by a so-called snow hood, such as the snow hoods disclosed in U.S. Pat. Nos. 3,757,367 and 3,807,187. These devices include a curved separator tube, sometimes referred to as a J-tube, in which liquid $CO_2$ is expanded and the resulting solid and gaseous $CO_2$ is separated by virtue of centrifugal force as the two-phase mixture flows through the curved path of the separator tube. In the prior art systems, a curved separator blade or scoop separates the solid carbon dioxide from the gaseous carbon dioxide and directs the solid carbon dioxide downwardly to the point of application. However, such separator blades tend to become clogged with solid carbon dioxide such that a heater is required to continuously or intermittently warm the separator blade. In addition, the stream of solid carbon dioxide is of narrow cross-section and is of relatively high velocity such that there is an uneven distribution of snow on the product which results in uneven and slower cooling rates. In addition, the design of the prior art snow hoods is such that a high velocity stream of upwardly flowing ambient air contacts the downwardly flowing stream of solid carbon dioxide, whereby some of the solid carbon dioxide is sublimed, while other portions are swept upwardly in the high velocity ambient air stream and are carried away in the exhaust gas duct. This results in a significant reduction in the amount of solid carbon dioxide snow which actually contacts the product relative to that amount which is theoretically available under any given set of operating conditions.

The present invention substantially reduces the loss of solid carbon dioxide and provides a stream of carbon dioxide which has a substantially larger and more uniform cross-sectional area with a lower downward velocity such that a uniform and optimum blanket of snow is deposited on the articles to be cooled. In addition, other advantages of the present invention will also be apparent from the following detailed description of one preferred embodiment of the invention.

SUMMARY OF THE INVENTION

The present invention comprises an improved snow hood in which a gas-solid separator concentrates the solid carbon dioxide snow into an upwardly directed high velocity stream which is injected into a reversing diffuser chamber to form a uniformly dispersed and low velocity stream of downwardly flowing $CO_2$ snow. The snow hood of the present invention also reduces the loss of $CO_2$ snow by separating the downwardly flowing $CO_2$ snow from upwardly flowing ambient air, and controls the velocity of the upwardly flowing air so that the $CO_2$ snow is not sublimed or carried away in the exhaust. In the preferred embodiment, condensed moisture is prevented from contacting the product by the provision of drip rails, and a diffuser controls the velocity and temperature of the exhausting $CO_2$ gas-air mixture so that the flexible plastic exhaust conduit is not subjected to embrittlement damage.

DETAILED DESCRIPTION

Figure 1:
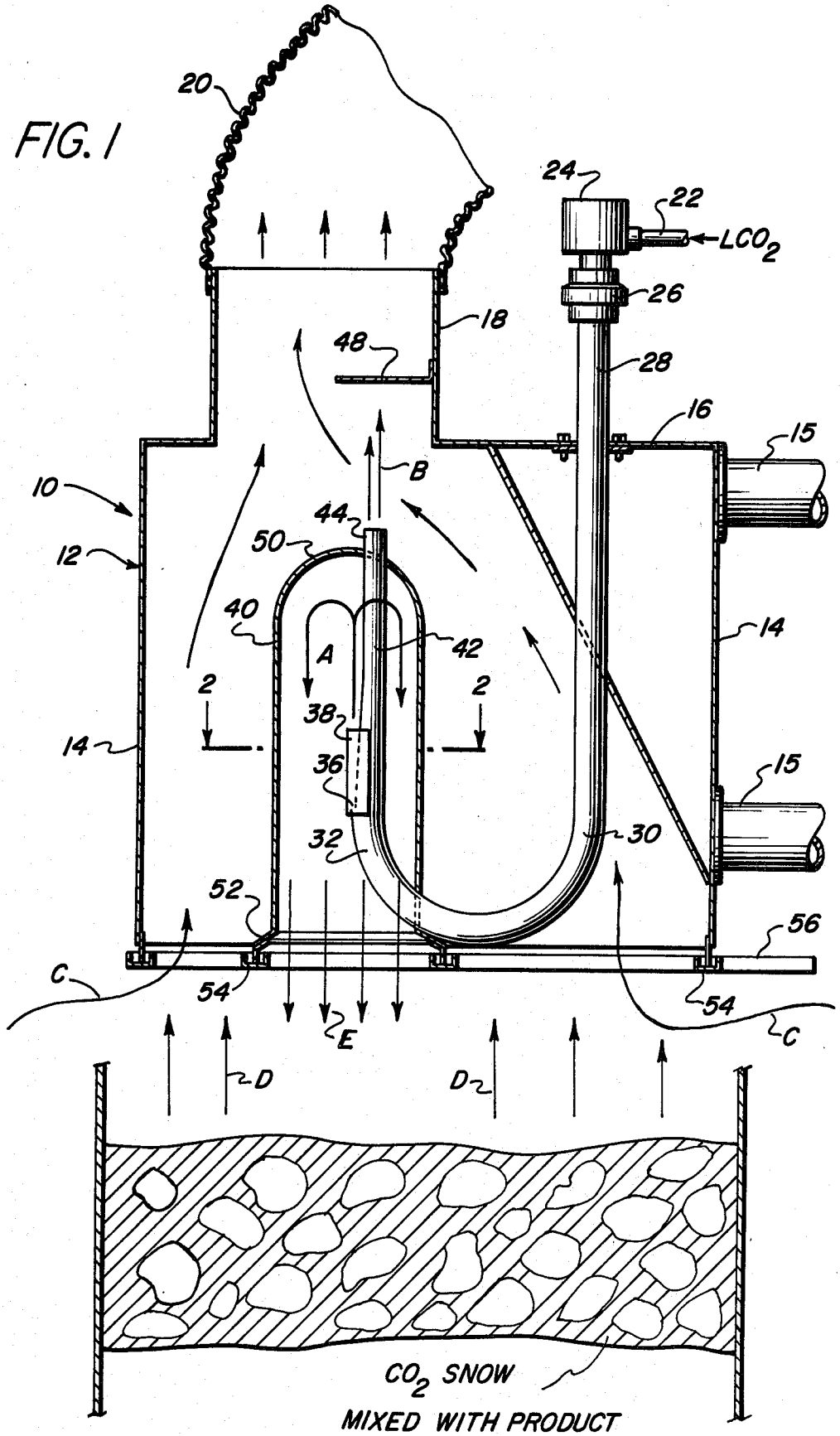
FIG. 1 is a side elevational view in cross-section showing the snow hood mounted above a container of product to be cooled.

Referring to FIG. 1, the snow hood 10 comprises a generally rectangular exhaust housing 12 formed by four side walls 14 and supported by arms 15. It will be understood that the other ends of arms 15 may be pivotally connected to a frame or stand whereby the snow hood may be swung into and out of position over the articles to be cooled in a container or mixer 11. The bottom of exhaust housing 12 is open while the top is closed by a cover 16 except for a vertical discharge path which is formed by discharge duct 18. Duct 18 is connected by an exhaust conduit 20 to a remote point of discharge, and exhaust conduit 20 may be a flexible plastic hose when the hood is mounted for pivoted movement.

The liquid carbon dioxide is supplied through a high pressure conduit 22 to a valve 24, which may be a solenoid operated valve, and through which the liquid $CO_2$ under high pressure is supplied to an expansion orifice 26. As is well-known, the expansion of high pressure liquid carbon dioxide to a pressure below the triple point, such as that approaching atmospheric pressure, produces a two-phase flow of gaseous and solid carbon dioxide in curved separator tube 28. As this high velocity stream of solid and gaseous carbon dioxide flows through the curved path formed by bend 30 of the tube, the particles of solid carbon dioxide become concentrated in a stream flowing along the outer radius of curvature while the gaseous portion occupies essentially the remainder of the cross-section of the tube. By the time the two-phase mixture reaches point 32, substantially all of the solid carbon dioxide is confined in a thin stream flowing along the inner surface of the radially outer wall of the tube. At this point, the prior art has utilized the above-indicated blade or scoop to deflect the stream of solid carbon dioxide downwardly onto the product. However, the present invention provides an open gap or slot 36, surrounded by a short vertically extending shield 38, so that the separated stream of solid carbon dioxide continues to flow upwardly as a high velocity stream A.

Figure 2:
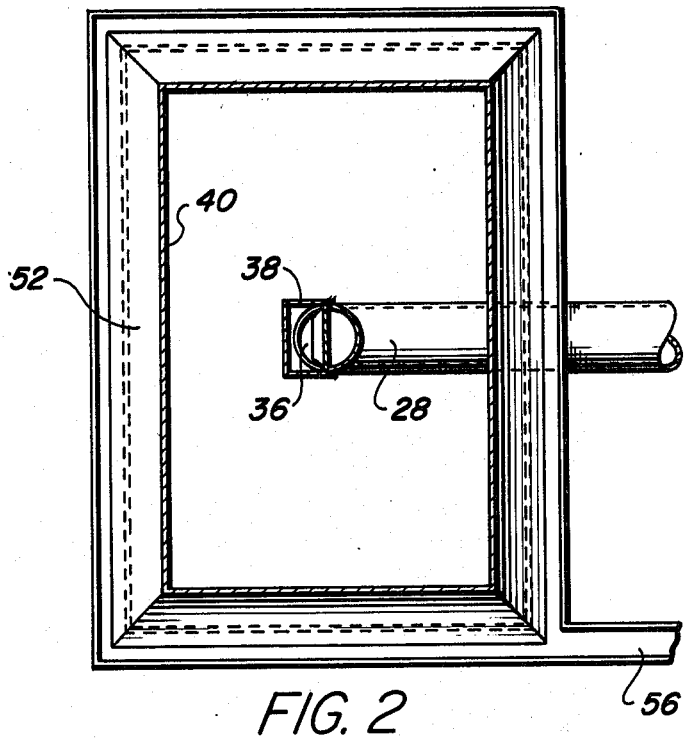
FIG. 2 is a cross-sectional view of the separator tube and reversing chamber taken along view line 2—2 of FIG. 1.
Figure 3:
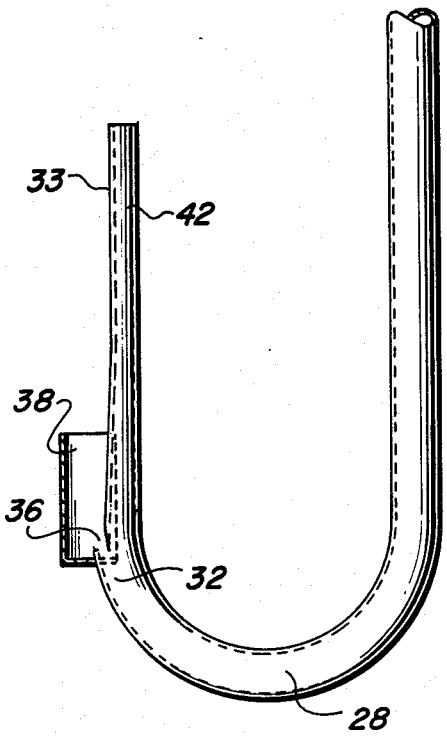
FIG. 3 is an enlarged, fragmentary view showing the details of the separator tube.
Figure 4:
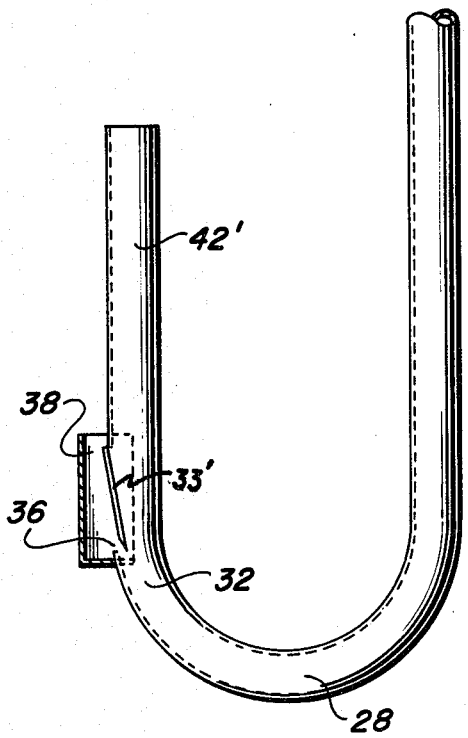
FIG. 4 is an enlarged, fragmentary view showing the details of an alternative form of the separator tube.

As shown more clearly in FIGS. 2 and 3, the separator tube 28 is cut away above point 32 and replaced by a flat plate 33 such that the area of gap 36 is a D-shaped section of a circle. Alternatively, the gap may be formed as shown in FIG. 4 such that portion 42' above the plate 33' is of the same cross-sectional area as the remainder of the separator tube. In either event, it has been found that the radial dimension of the gap should be in the order of 12 to 15% of the internal diameter of the separator tube for best results.

The separated gaseous stream continues to flow upwardly within tube portion 42 out of contact with the solid stream A which is confined within a reversing diffuser chamber 40. The cold gaseous stream B exits from tip 44 of the separator tube as a high velocity jet such that some warm ambient air, represented by arrows C, is drawn into the exhaust housing 12 along with $CO_2$ gas D resulting from sublimation of the solid $CO_2$ in contact with the product. However, the discharge of the air and $CO_2$ gas from the hood is controlled by the provision of a second diffuser in the form of a deflector plate 48. Plate 48 forces the gaseous $CO_2$ and air to mix and to flow latterally before exiting through discharge duct 18. Accordingly, the high velocity jet of cold $CO_2$ gas B is dispersed and its velocity is substantially reduced so that the velocity of the exhausted mixture is quite low above the deflector plate. The warm ambient air is well mixed with the cold carbon dioxide gas and warms the latter such that duct 20 may be composed of thin, flexible plastic material without danger of embrittlement.

Referring back to the reversing diffuser chamber 40, the chamber is illustrated as having a rectangular cross-sectional area and a curved upper portion 50, although it will be apparent that the chamber may be of any suitable cross-section. For example, it may be circular in cross-section such that the upper portion 50 would be hemi-spherical. Reversing diffuser chamber 40 serves to disperse and reverse the upwardly flowing stream A of solid carbon dioxide particles into a low velocity downward flow which is substantially uniform throughout the cross-sectional area of the reversing diffuser chamber. While the reversal of stream A is shown in idealized form, it will be understood that the high velocity stream produces violent mixing in the upper portion of chamber 40 which disperses the solid $CO_2$ particles throughout the cross-sectional area of chamber 40. This uniformly distributed and low velocity stream then exits the bottom of the reversing diffuser chamber as shown by arrows E such that the solid carbon dioxide snow is evenly deposited on the product being cooled which is located directly there below.

The bottom of the reversing diffuser chamber 40 is preferably formed with an outwardly flared skirt 52 so that any moisture from the ambient air which condenses on the walls of the chamber 40 flows downwardly and away from the central discharge area represented by flow lines E. In addition, the preferred embodiment of the invention includes U-shaped drip rails 54 connected to the bottom of skirt 52, as well as side walls 14 of the exhaust housing 12, so that such condensation is collected and prevented from dripping on the product to be cooled. The drip rails 54 are connected to a discharge header 56 through which the collected water may be discharged at a point remote from the product being cooled by the carbon dioxide snow.

From the foregoing description it will be apparent that the present invention provides a uniform distribution of the carbon dioxide snow on the product in a low velocity stream which is separated from the upwardly flowing ambient air so that solid particles of carbon dioxide are neither sublimed nor swept upwardly through the discharge duct. As a result, tests of a snow hood operating according to the present invention have shown more than a 16% increase in the amount of snow actually deposited on the product relative to the snow hoods of the prior art described hereinabove. In addition, the product has not been damaged by condensation dripping downwardly from the snow hood, and the flexible exhaust conduit 20 has suffered no embrittlement damage.

Of course, numerous variations in the structural design of the present invention will be apparent to those skilled in the art such that the foregoing description of one preferred embodiment is intended to be merely illustrative of the invention, and the true invention is not to be limited other than as set forth in the following claims.

What is claimed is:

1. A snow hood for depositing carbon dioxide snow on a product comprising:

(a) an exhaust housing having an open bottom, (b) a reversing diffuser chamber within said exhaust housing having side walls, a closed upper end, and an open bottom, (c) means for separating a two-phase flow of gaseous and solid carbon dioxide into separate high velocity streams of gaseous and solid carbon dioxide, and (d) means for directing said high velocity stream of solid carbon dioxide upwardly into said reversing diffuser chamber whereby said stream is reversed, diffused and reduced in velocity to form a dispersed, downwardly flowing, low velocity stream of carbon dioxide snow.

2. The snow hood as claimed in claim 1 including drip rails positioned at the lower edge of the walls of the reversing diffuser chamber for collecting condensation.

3. The snow hood as claimed in claims 1 or 2 where means (c) comprise a separator tube, and means (d) comprise a slot and flow directing shield.

4. The snow hood as claimed in claim 1 including means for directing the high velocity stream of separated carbon dioxide gas upwardly within said exhaust housing to aspirate a flow of warm ambient air upwardly through said exhaust housing, means for mixing said warm air and cold carbon dioxide gas, and discharge means in the top of said exhaust housing for discharging said mixture of gaseous carbon dioxide and air.

5. The snow hood as claimed in claim 4 including diffuser means for reducing the velocity of the gaseous carbon dioxide stream and promoting thorough mixing thereof with the ambient air prior to discharge of the mixture from said snow hood.

* * * * *